US008866838B2

(12) United States Patent
Marcu et al.

(10) Patent No.: US 8,866,838 B2
(45) Date of Patent: Oct. 21, 2014

(54) COLOR MANAGEMENT FOR MULTIPLE DISPLAY PRESENTATION OF VISUAL MEDIA

(75) Inventors: Gabriel G. Marcu, San Jose, CA (US); Steve Swen, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 742 days.

(21) Appl. No.: 12/928,062

(22) Filed: Dec. 1, 2010

(65) Prior Publication Data

US 2012/0139937 A1 Jun. 7, 2012

(51) Int. Cl.
*G09G 5/02* (2006.01)
*G09G 3/20* (2006.01)

(52) U.S. Cl.
CPC ..... *G09G 3/2003* (2013.01); *G09G 2320/0673* (2013.01); *G09G 2320/0285* (2013.01)
USPC ..... 345/590; 358/1.9

(58) Field of Classification Search
None
See application file for complete search history.

(56) References Cited

U.S. PATENT DOCUMENTS

| | | | | |
|---|---|---|---|---|
| 6,603,879 | B2 | 8/2003 | Haikin et al. | |
| 6,937,249 | B2 | 8/2005 | Herbert et al. | |
| 7,457,003 | B1 * | 11/2008 | Marcu et al. | 358/1.9 |
| 7,609,413 | B1 | 10/2009 | Marcu et al. | |
| 7,711,185 | B2 | 5/2010 | Gibson et al. | |
| 2009/0007158 | A1 * | 1/2009 | Azmi et al. | 719/328 |
| 2009/0184975 | A1 | 7/2009 | Yao et al. | |
| 2009/0309808 | A1 * | 12/2009 | Swingler | 345/1.3 |

FOREIGN PATENT DOCUMENTS

| | | | |
|---|---|---|---|
| EP | 1397795 | B1 * | 4/2007 |
| WO | WO-02/097783 | | 12/2002 |

OTHER PUBLICATIONS

[online], [retrieved Apr. 11, 2013], Willis, A. "Using the Display Preference Pane in System Preferences", https://core24.zendesk.com/entries/156847-Using-the-Display-Preference-Pane-in-System-Preferences, Apr. 15, 2010.*

[online], [retrieved Apr. 12, 2013], Cooper, K. "Improving your Mac's Color", http://web.archive.org/web/20090831091038/http://www.northlight-images.co.uk/article_pages/improve_mac_color.html, Aug. 2009.*

* cited by examiner

*Primary Examiner* — Ulka Chauhan
*Assistant Examiner* — Patrick F Valdez
(74) *Attorney, Agent, or Firm* — Blakely, Sokoloff, Taylor & Zafman LLP

(57) ABSTRACT

Methods and data processing systems are disclosed for color management in a multiple display system. In one embodiment, a computer-implemented method includes color managing media based on a color gamut of a first display. Then, the method mirrors the media in a mirrored mode onto the first display and a second display. Then, the method processes the media for the second display through a gamma information for the second display. The gamma information is for a non-mirrored mode for the second display. The first and second displays may have different color gamuts. These color gamuts can be used for generating or modifying the gamma information for the second display. The gamma information may provide a color management for the second display that is based on the second display and is independent of the first display.

23 Claims, 11 Drawing Sheets
(7 of 11 Drawing Sheet(s) Filed in Color)

COLOR MANAGEMENT FOR MULTIPLE DISPLAY PRESENTATION OF VISUAL MEDIA

FIELD OF THE DISCLOSURE

Embodiments of the present disclosure generally relate to color management for multiple display presentation of visual media.

BACKGROUND OF THE DISCLOSURE

Electronic devices, such as computer systems or wireless cellular telephones or other data processing systems, may often include a display or display device, such as a liquid crystal display (LCD) or light emitting diode (LED) display, for providing a user interface with various images, programs, menus, documents, and other types of information. The display may illuminate or display various colors with a color space such as the CIE XYZ color space created by the International Commission on Illumination in 1931. A specific method for associating three numbers (or tristimulus values) with each color is called a color space. The human eye has receptors for short, middle, and long wavelengths, also know as blue, green, and red receptors. The CIE XYZ color space includes a set of tristimulus values called X, Y, and Z which are also roughly red, green, and blue, respectively.

The concept of color includes brightness and chromaticity. For example, the color white is a bright color while the color grey is considered to be a less bright version of that same white color. In other words, the chromaticity of white and grey are the same while their brightness differs. The CIE XYZ color space was deliberately designed so that the Y parameter was a measure of the brightness or luminance of a color. The chromaticity of a color was then specified by the two derived parameters x and y, which are functions of all three tristimulus values X, Y, and Z. FIG. 1 illustrates a CIE (1931) xy chromaticity diagram with all of the chromaticities visible to the average person. This region is called the gamut of human vision. The gamut of all visible chromaticities on the CIE plot is the tongue-shaped or horseshoe-shaped object. The curved edge of the gamut is called the spectral locus and corresponds to monochromatic light.

The color temperature of a light source is determined by comparing its hue with a theoretical, heated black-body radiator. Hue is that aspect of a color described with names such as "red", "yellow", etc. The Kelvin temperature at which the heated black-body radiator matches the hue of the light source is that source's color temperature. An incandescent light is very close to being a black-body radiator. However, many other light sources, such as fluorescent lamps, do not emit radiation in the form of a black-body curve, and are assigned what is known as a correlated color temperature (CCT), which is the color temperature of a black body which most closely matches the lamp's perceived color. Some common examples of color temperatures include a 2800 K Tungsten lamp (incandescent lightbulb), a 4100 K Moonlight, a 5000 K Daylight (D50), 6500 K Daylight (D65), and a 9300 K TV screen (analog). FIG. 1 also illustrates a black body locus or white point locus, with color temperatures indicated. The lines crossing the black body locus are lines of constant correlated color temperature.

The display of an electronic device may need to be calibrated in order to better match colors between the display and other types of media including other displays, paper sources, etc. One prior system with multiple displays includes an operating system and frame buffers for each display. Each frame buffer uses a color profile associated with the corresponding display that it drives; this can be referred to as "non-mirrored mode." For example, a first color profile and first look-up table (LUT) can be associated with a first display and a second different color profile and second different LUT can be associated with a second display. This provides independent color management per each display. Display data is buffered in window buffers and then transferred to frame buffers to display the corresponding media on the displays.

Another prior system can use two displays to show the same image; this can be referred to as "mirrored mode." In this case, the display is driven with display data that is processed with a single color profile designed for one of the two displays. However, the displays may have different color gamuts. The system performs color management for one of the displays with one color profile and the display data to be displayed is mirrored onto both displays. In this case, since color management is performed for only one of the displays, the color presented on one display differs from the color presented on the other display.

SUMMARY OF THE DISCLOSURE

At least certain embodiments of the disclosures relate to methods and data processing systems for color management of a multiple display system. In one embodiment, a computer-implemented method includes color managing media based on a color gamut of a first display. The media can be display data or pixel values for an image or sequence of images or visual content. The media is mirrored in a mirrored mode onto the first display and a second display. Then, the media is processed for the second display through gamma information for the second display. The gamma information is for a non-mirrored mode for the second display. The first and second displays may have different color gamuts. These color gamuts can be used for generating the gamma information for the second display. For example, a ratio of the respective areas of the color gamuts can be determined in order to determine a saturation correction. Hue data of the color gamuts can be compared to determine a hue correction. A gamma correction to generate or modify the gamma information for the second display can be performed based on at least one of the saturation correction and the hue correction. The modified gamma information can be stored in a Look Up Table (LUT) in a memory device, and this LUT can be used to apply a transfer function to display data that is used as an input to the LUT, and the output from the LUT is then used to drive a pixel on the display device. Each pixel value in one embodiment is obtained by using an input (display data) value to address the LUT to obtain the output value from the LUT which then drives the corresponding pixel on the display device. The modified gamma information can provide a color profile or color management system for the second display that is based on the second display's gamut (rather than the first display's gamut) and is independent of the first display and its gamut. The modified gamma information is configured to perform color management as if the second display is not in a mirrored mode because it is configured based on the second display's gamut or other display characteristics and is configured independently of the first display.

In one embodiment, a data processing system includes a first display device and a second display device to display media. The system includes one or more processing units that are coupled to the first display device and the second display device. The one or more processing units are configured to execute instructions to color manage input media having a media profile based on a color gamut of the first display, to store the media in a frame buffer, to mirror the stored media in a mirrored mode onto the first and second displays, and to process the media for the second display through gamma information for the second display. The gamma information is for a non-mirrored mode for the second display.

Other systems and methods are also described, and machine readable media, which contain executable instructions to cause a machine to operate as described herein, are also described.

BRIEF DESCRIPTION OF THE DRAWINGS

The patent or application file contains at least one drawing executed in color. Copies of this patent or patent application publication with color drawings will be provided by the Office upon request and payment of the necessary fee.

The present disclosure is illustrated by way of example and not limitation in the figures of the accompanying drawings in which like references indicate similar elements.

DETAILED DESCRIPTION

Methods and data processing systems are disclosed for color management in a multiple display system. In one embodiment, a computer-implemented method includes color managing media based on a color gamut of a first display. Then, the method mirrors the stored media in a mirrored mode onto the first display and a second display. Then, the method processes the media for the second display through generating or modifying gamma information for the second display. The gamma information is for a non-mirrored mode for the second display. The first and second displays may have different color gamuts. These color gamuts can be used for generating or modifying the gamma information for the second display. Thus, the media can be displayed on the second display using a gamma correction that is based on a saturation correction and a hue correction, but without using a profile of the second display to color manage the second display.

Figure 1:
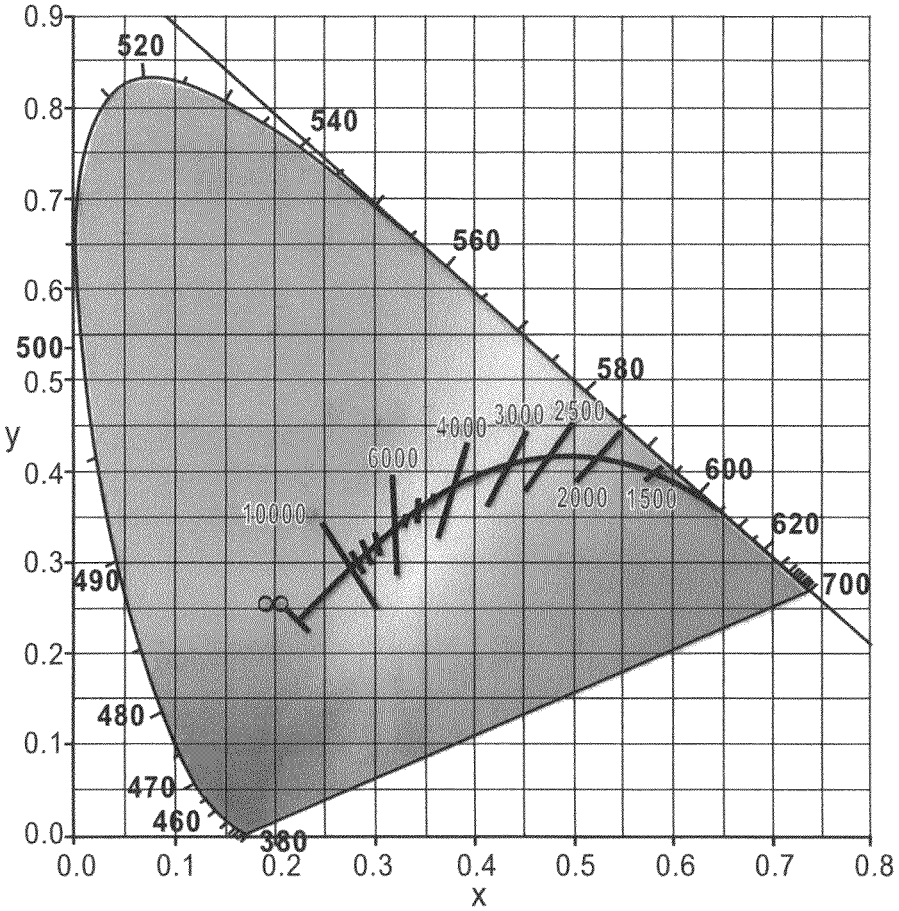
FIG. 1 (PRIOR ART)
FIG. 1 shows a CIE xy chromaticity diagram.
Figure 2:
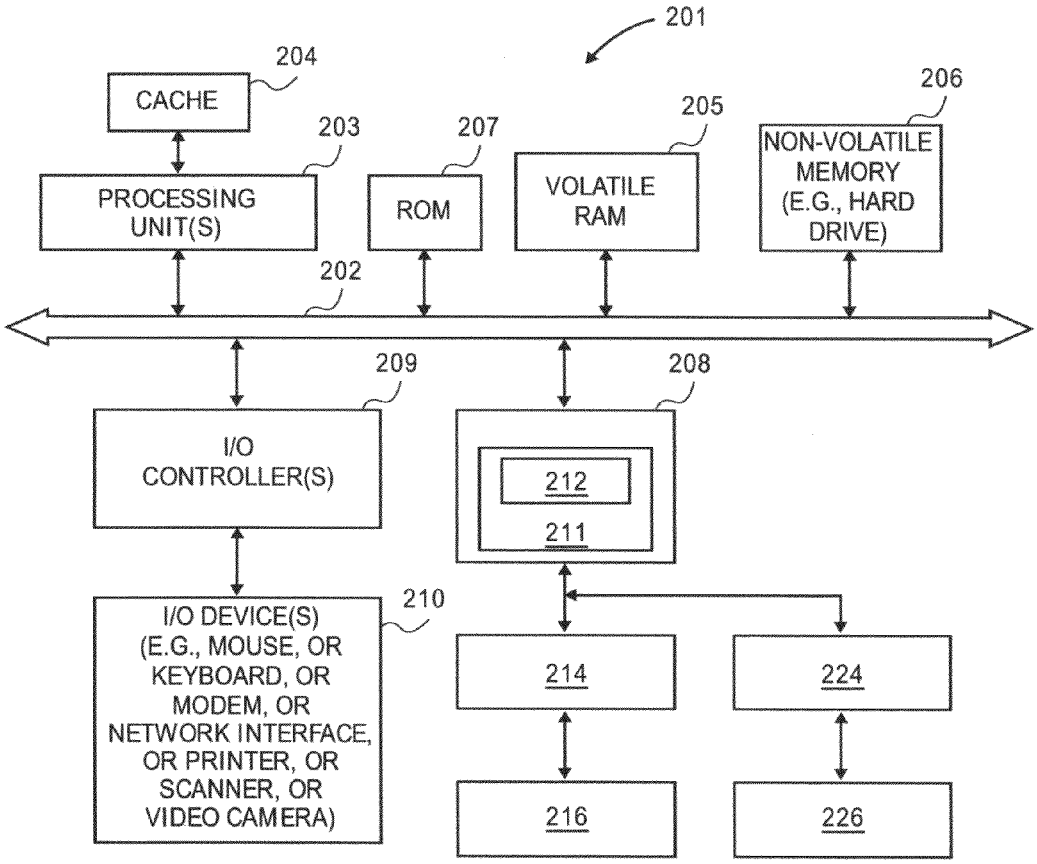
FIG. 2 shows an example of a data processing system with multiple displays in a mirrored mode in one embodiment of the present invention.

FIG. 2 shows an example of a data processing system with multiple displays in a non-mirrored mode in one embodiment of the present invention. Note that while FIG. 2 illustrates various components of a computer system, it is not intended to represent any particular architecture or manner of interconnecting the components as such details are not germane to the present disclosure. It will also be appreciated that personal digital assistants (PDAs), handheld computers (e.g., an iPad), cellular telephones (e.g., an iPhone), media players (e.g., an iPod), devices which combine aspects or functions of these devices, an embedded processing device within another device, network computers and other data processing systems which have fewer components or perhaps more components may also be used to implement one or more embodiments of the present disclosure. The computer system of FIG. 2 may, for example, be an Apple Macintosh computer.

As shown in FIG. 2, the computer system 201, which is a form of a data processing system, includes a bus 202 which is coupled to one or more processing units 203 and a ROM 207 and volatile RAM 205 and a non-volatile memory 206. The one or more processing units 203 are coupled to cache memory 204 as shown in the example of FIG. 2. The bus 202 interconnects these various components together and also interconnects these components 203, 207, 205, and 206 to display controller 208. The display controller 208 may include a frame buffer 211, which may be assigned a color profile 212 for the display 216. Look up tables 214 and 224 provide color correction information (e.g., gamma correction) for the respective displays 216 and 226. Each look-up table (LUT) may be located in a graphics card. Each LUT is assigned to a display and the LUT converts color data from a target transfer function (e.g., gamma=2.2) to a native transfer function for the display.

The bus 202 also interconnects to peripheral devices such as input/output (I/O) devices 210 which may be mice, keyboards, modems, network interfaces, printers, scanners, video cameras and other devices which are well known in the art.

In color matching, if a source profile is equal to a destination profile, then no color matching operation is needed. However, if a source profile is different than a destination profile, then a color matching operation from source to destination is performed.

At least one embodiment of the present disclosure seeks to describe a data processing system 201 that includes one or more processing units 203 coupled to a bus 202. The data processing system 201 further includes displays (e.g., display devices) 216 and 226 coupled to the bus 202. The processing units are configured to execute instructions to color manage input media having a media profile based on a color gamut of one of the displays (e.g., 216, 226) and to store the color managed media in a frame buffer (e.g., 211). The one or more processing units are configured to execute instructions to mirror the stored media in a mirrored mode onto both displays (e.g., 216, 226). In one embodiment, displays have different color gamuts. The one or more processing units are configured to execute instructions to process the media for the second display (e.g., 226) by modifying gamma information for the second display to approximate gamma information for a non-mirrored mode for the second display. The gamma information may be stored in a LUT for the second display.

The one or more processing units may be configured to execute instructions to determine a gamut ratio of the gamut size (e.g., area, volume, perimeter, etc.) of the first display to the gamut size of the second display (e.g., area, volume, perimeter, etc.), to determine a saturation correction based on the gamut ratio, and to determine a gamma correction to modify the gamma information for the LUT (e.g., 224) of the second display based on the saturation correction.

The one or more processing units may be configured to execute instructions to compare hue data associated with the color gamut of the first display (e.g., 216) to hue data associated with the color gamut of the second display, to determine a hue correction based on the comparison of the hue data, and to determine a gamma correction to modify the gamma information for the LUT of the second display based on the hue correction. The gamma correction that modifies the gamma information may include at least one of the saturation correction and the hue correction. The gamma correction that modifies the gamma information may include both the saturation correction and the hue correction.

The frame buffer(s) are used to refresh multiple displays (e.g., display devices) or the frame buffer(s) may be in a system RAM (e.g., RAM 205). Typically, the input/output devices 210 are coupled to the system through input/output controllers 209. The volatile RAM 205 is typically implemented as dynamic RAM (DRAM) which requires power continually in order to refresh or maintain the data in the memory. The non-volatile memory 206 is typically a magnetic hard drive or a magnetic optical drive or an optical drive or a DVD RAM or other type of memory systems which maintain data even after power is removed from the system. Typically, the non-volatile memory will also be a random access memory although this is not required. While FIG. 2 shows that the non-volatile memory is a local device coupled directly to the rest of the components in the data processing system, it will be appreciated that the present disclosure may utilize a non-volatile memory which is remote from the system, such as a network storage device which is coupled to the data processing system through a network interface such as a modem or Ethernet interface. The bus 202 may include one or more buses connected to each other through various bridges, controllers and/or adapters as is well known in the art. In one embodiment the I/O controller 209 includes a USB (Universal Serial Bus) adapter for controlling USB peripherals, and/or an IEEE-1394 bus adapter for controlling IEEE-1394 peripherals.

It will be apparent from this description that aspects of the present disclosure may be embodied, at least in part, in software. That is, the techniques may be carried out in a computer system or other data processing system in response to its processor, such as a microprocessor, executing sequences of instructions contained in a memory, such as ROM 207, volatile RAM 205, non-volatile memory 206, cache 204 or a remote storage device. In various embodiments, hardwired circuitry may be used in combination with software instructions to implement the present disclosure. Thus, the techniques are not limited to any specific combination of hardware circuitry and software nor to any particular source for the instructions executed by the data processing system. In addition, throughout this description, various functions and operations are described as being performed by or caused by software code to simplify description. However, those skilled in the art will recognize what is meant by such expressions is that the functions result from execution of the code by a processor, such as the one or more processing units 203.

Figure 3:
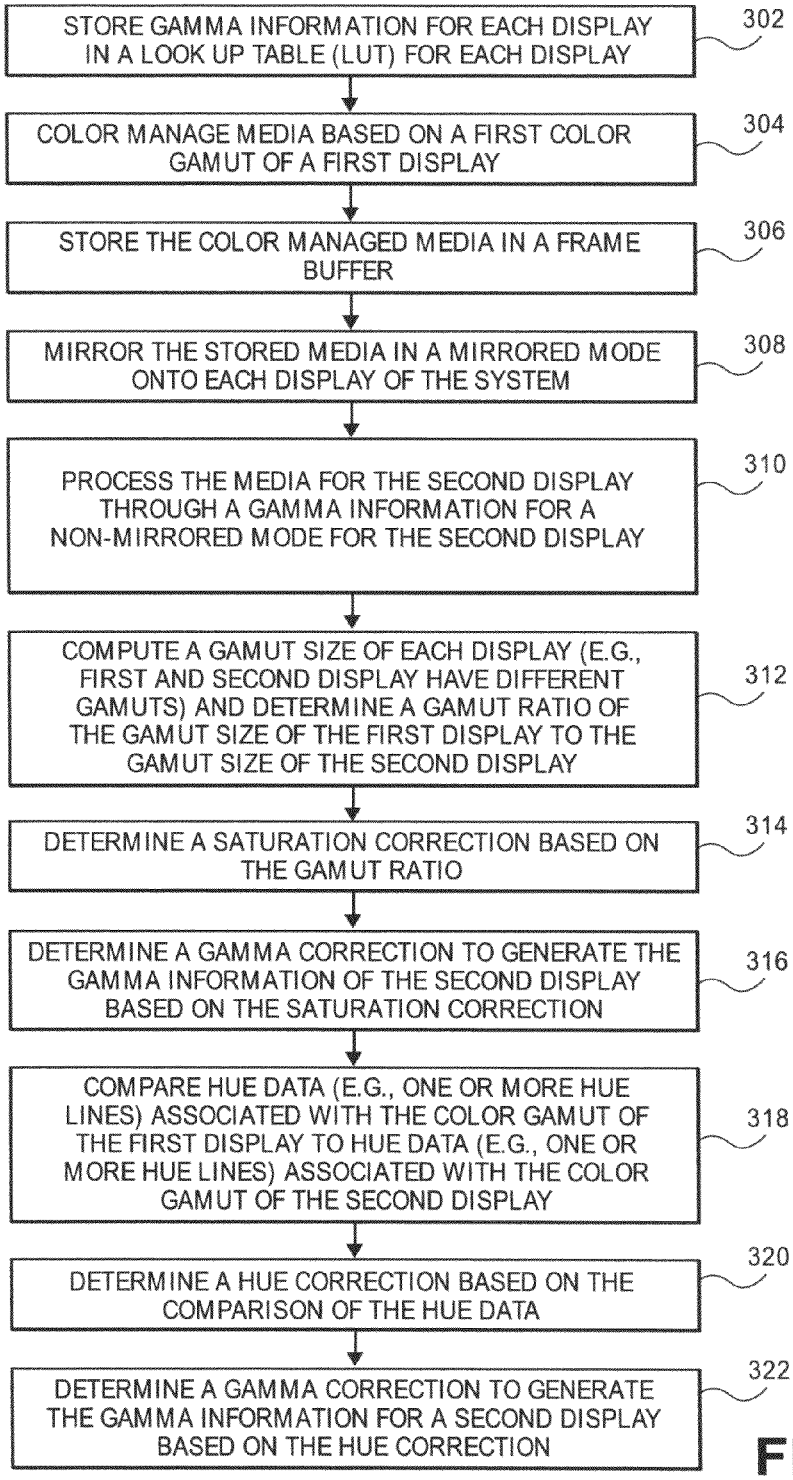
FIG. 3 illustrates a flow diagram in one embodiment of the present invention for a computer-implemented method 300 of providing color correction for multiple displays in a data processing system.

FIG. 3 illustrates a flow diagram in one embodiment of the present invention for a computer-implemented method 300 of providing color correction for multiple displays in a data processing system. The computer-implemented method 300 is performed by processing logic that may comprise hardware (circuitry, dedicated logic, etc.), software (such as is run on a general purpose computer system or a dedicated machine or a system), or a combination of both. In one embodiment, the processing logic includes a multiple display system that is being implemented in a mirrored mode.

At block 302, processing logic stores gamma information for each display in a look up table (LUT) for each display. At block 304, processing logic color manages media based on a first color gamut of a first display. At block 306, processing logic stores the color managed media in a frame buffer. At block 308, the processing logic mirrors the stored media in a mirrored mode onto each display of the system (e.g., the first display and a second display). In one embodiment, the first and second displays have different color gamuts.

At block 310, the processing logic processes the media for the second display through a gamma information for the second display. The gamma information is designed for a non-mirrored mode with color management for the second display (even though the media is mirrored onto the first and second display). At block 312, the processing logic computes a gamut size (e.g., area, volume, perimeter, etc.) of each display (e.g., first and second displays) and determines a gamut ratio of the gamut size of the first display to the gamut size of the second display. At block 314, the processing logic determines a saturation correction based on the gamut ratio. At block 416, the processing logic determines a gamma correction to generate the gamma information of the second display based on the saturation correction. At block 318, the processing logic compares hue data (e.g., one or more hue lines) associated with the color gamut of the first display to hue data (e.g., one or more hue lines) associated with the color gamut of the second display. At block 320, the processing logic determines a hue correction based on the comparison of the hue data. At block 322, the processing logic determines a gamma correction to generate the gamma information for the second display based on the hue correction. The gamma correction that generates or modifies the gamma information may include at least one or both of the saturation correction and the hue correction. Thus, the media can be displayed on the second display using a gamma correction that is based on a saturation correction and a hue correction, but without color management of the second display (e.g., without using a profile of the second display to color manage the second display).

Figures 4, 5:
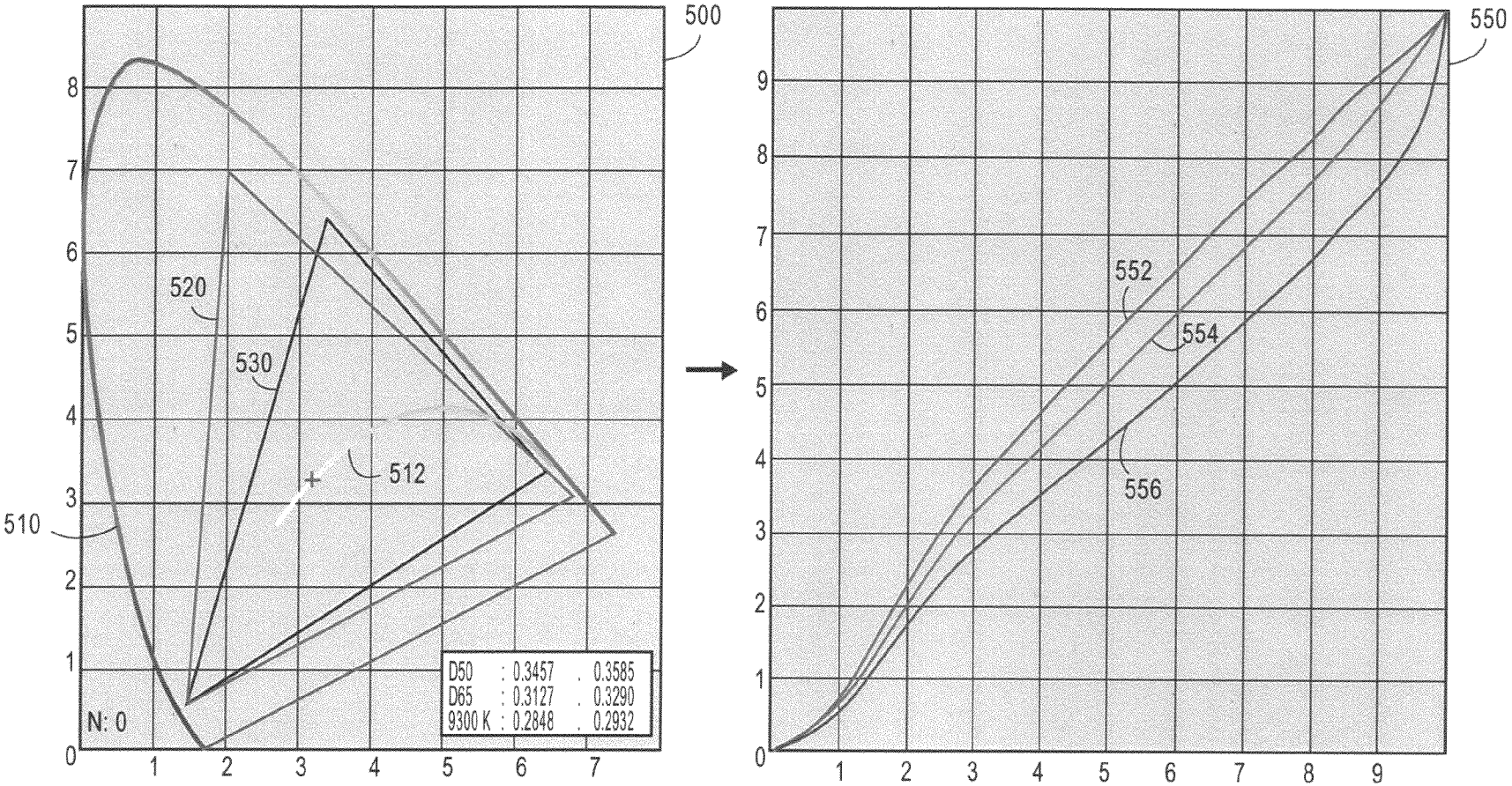
FIG. 4 shows a CIE chromaticity diagram with gamuts for multiple displays in one embodiment of the present invention.
FIG. 5 illustrates a gamma diagram for a non-color managed display of a multiple display system in one embodiment of the present invention.

FIG. 4 shows a CIE 1931 chromaticity diagram with gamuts for multiple displays in one embodiment of the present invention. The chromaticity diagram 500 includes x and y chromaticity coordinates derived from the tristimulus values X, Y, and Z, a color gamut 510 for all visible chromaticities, a black body locus or white point locus 512, a color gamut 520 for a first display in a system, and a color gamut 530 for a second display in the system.

In one embodiment, media is stored in a frame buffer with a first profile. Color management is performed using the first profile and a first LUT in order to present media onto the first display based on the gamut 520. A device profile characterizes the relation between the color data (e.g., color components detected, color components to be printed or displayed) for the device and the color on the device (e.g., color to be scanned, color print-out, or color displayed). Color data for the device is generated from or used to generate the color on the color device. A typical device profile includes data for converting between color on device, which is typically represented in a device independent color space (e.g., L*a*b*) as a result of instrumental measurements, and color data, which is typically represented in a device dependent color space (e.g., RGB) as a signal generating, or being generated from, the color on device. Thus, the device profile is essentially a digital representation of the color conversion capability of the color device. The device profile can be in terms of a gamma, a look up table or matrix for chromaticity data, and/or other parameters.

When a color data is converted to the color on the device according to a device profile and converted back to another color data according to another device profile, the result is a color correction to account for the differences between the devices. Thus, a number of device profiles can be created for a color device operating under a number of different conditions so that color correction can be performed using the device profiles.

The first profile can be used for matrix multiplication of received media data (e.g, image data) to derive values (e.g., chromaticity values) in the first frame buffer. This media may be mirrored to the second display. In this case, no color correction occurs for the second display using a color profile for the second display and a second LUT. Rather, chromaticity differences arise based on the second display having a different gamut 530 than the gamut 520 of the first display.

FIG. 5 illustrates a gamma diagram 550 for a non-color managed display of a multiple display system in one embodiment of the present invention. The gamma diagram 550 illustrates gamma with a red component 552, a green component 554, and a blue component 556 for the second display. A gamut translation can result in a gamma correction for the second display.

Figure 6B:
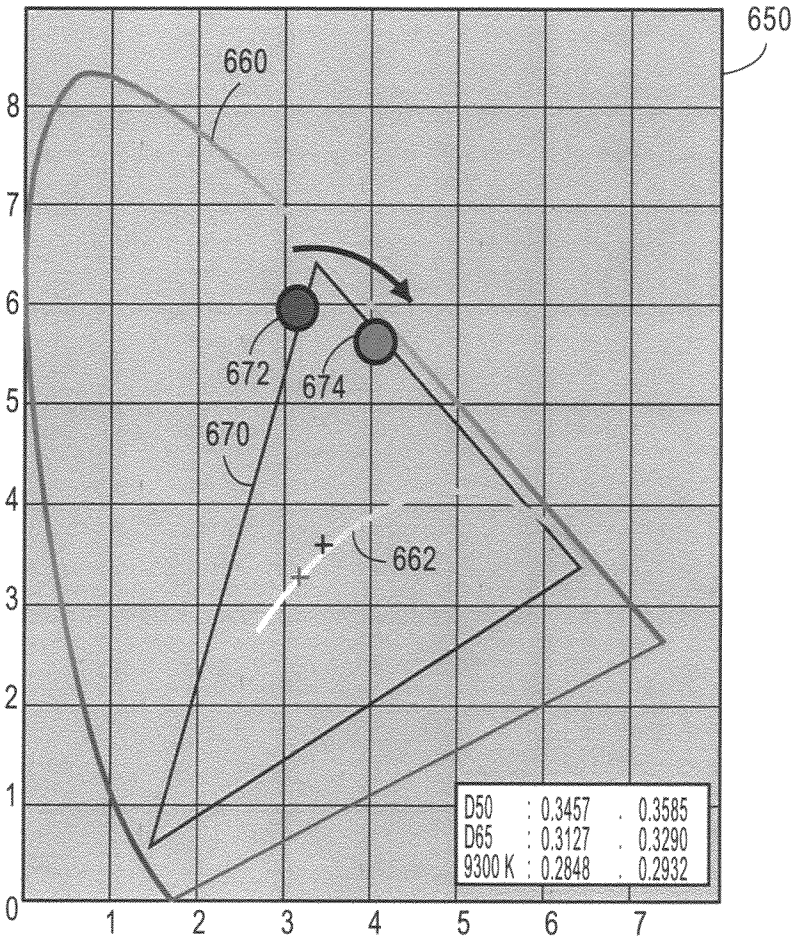
FIG. 6B shows a CIE chromaticity diagram with a gamut for a non-color managed display in one embodiment of the present invention.
Figure 6A:
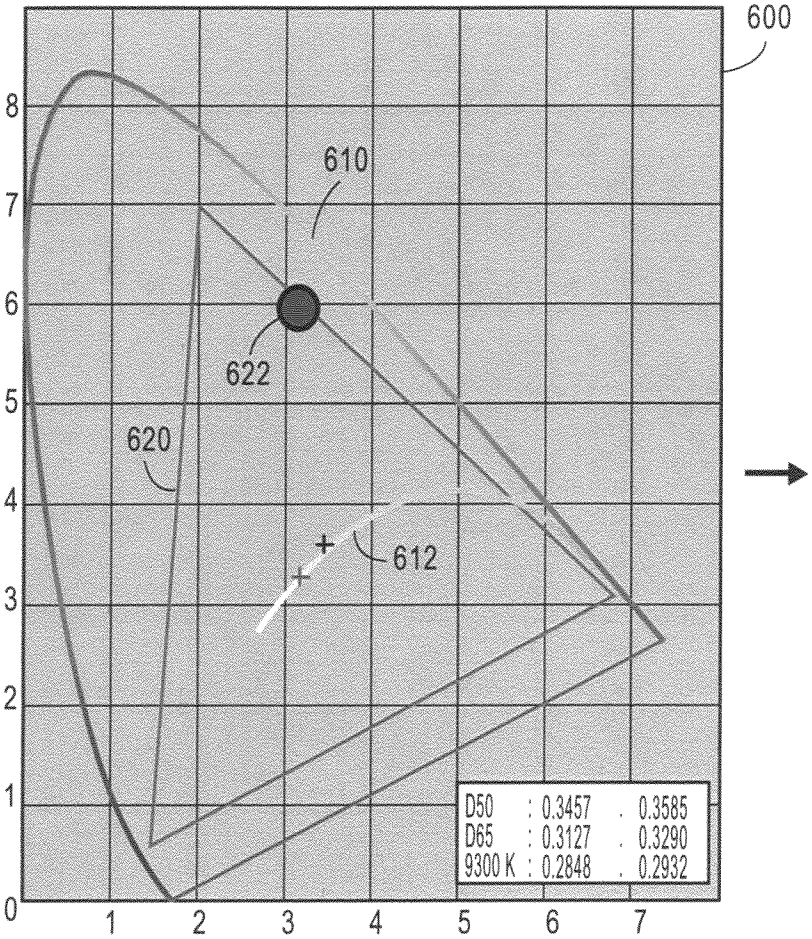
FIG. 6A shows a CIE chromaticity diagram with a gamut for a color managed display in one embodiment of the present invention.

FIG. 6A shows a CIE 1931 chromaticity diagram with a gamut for a color managed display in one embodiment of the present invention. The chromaticity diagram 600 includes x and y chromaticity coordinates derived from the tristimulus values X, Y, and Z, a color gamut 610 for all visible chromaticities, a black body locus or white point locus 612, a color gamut 620 for a color managed display in a system, and a point 622 on the boundary of gamut 620 having a certain red to green ratio (e.g., 0.8).

FIG. 6B shows a CIE 1931 chromaticity diagram with a gamut for a non-color managed display in one embodiment of the present invention. The chromaticity diagram 650 includes x and y chromaticity coordinates derived from the tristimulus values X, Y, and Z, a color gamut 660 for all visible chromaticities, a black body locus or white point locus 662, and a color gamut 670 for a non-color managed display in a system. The point 672 has the same xy coordinate as the point 622 in FIG. 6A. This point 672 is translated to a point 674 on the boundary of gamut 670 having the same red to green ratio (e.g., 0.8) as point 622. This translation represents a saturation difference between the gamut 620 and the gamut 670. Saturation increases towards a boundary or edge of a gamut size.

It should be appreciated that the systems and methods of the present disclosure can be implemented in other color spaces that have a reversible transformation between and to xyY space such as the CIELAB (CIE 1976 L*a*b* color space) and CIELUV color spaces.

Figure 8:
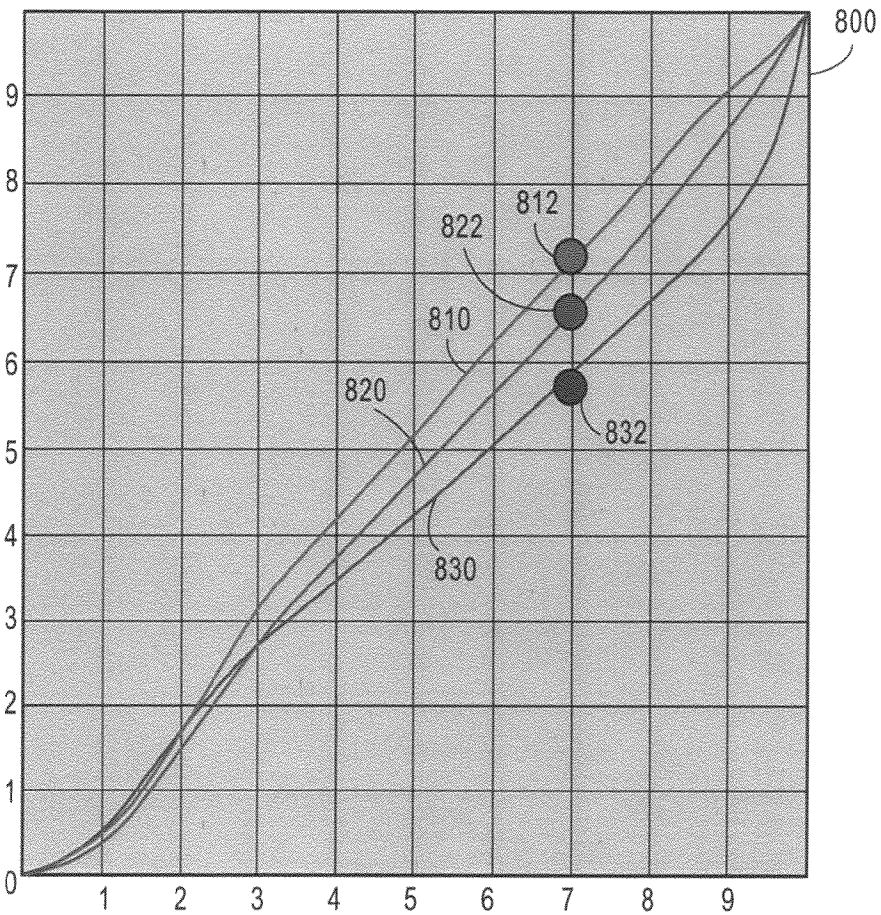
FIG. 8 illustrates a gamma diagram being modified for the non-color managed display in one embodiment of the present invention.
Figure 7:
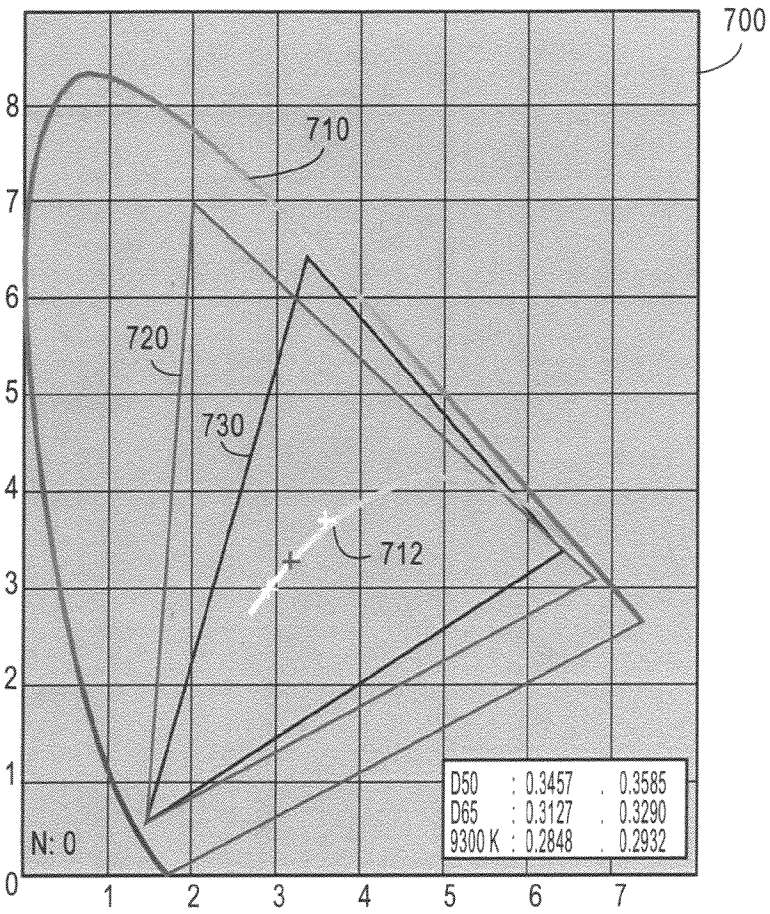
FIG. 7 shows a CIE chromaticity diagram with a gamut for a color managed display and a gamut for a non-color managed display in one embodiment of the present invention.

FIG. 7 shows a CIE 1931 chromaticity diagram with a gamut for a color managed display and a gamut for a non-color managed display in one embodiment of the present invention. The chromaticity diagram 700 includes x and y chromaticity coordinates derived from the tristimulus values X, Y, and Z, a color gamut 710 for all visible chromaticities, a black body locus or white point locus 712, a color gamut 720 for a color managed display in a system, and a color gamut 730 for a non-color managed display in the system. A saturation correction ratio equals an area of gamut 720 divided by an area of gamut 730. If the ratio approaches zero, then color is compromised. In most cases saturation may be perceptually correlated with the contrast, which is controlled by a LUT (e.g., 314, 324). Thus, the saturation correction ratio may be used as a gamma correction with "a" being approximately equal to a global gamma correction as illustrated in FIG. 8 which illustrates a gamma diagram being modified for the non-color managed display in one embodiment of the present invention. The horizontal axis represents input values and the vertical axis represents output values. The global gamma correction can be applied to each gamma curve (e.g., red, green, blue) of the non-color managed display to modify the LUT of the non-color managed display. Alternatively, a red component of the global gamma correction "$a_r$" can be applied to the red curve, a green component of the global gamma correction "$a_g$" can be applied to the green curve, and a blue component of the global gamma correction "$a_b$" can be applied to the blue curve. In this manner, the LUT for the non-color managed display is modified to account for the saturation difference between the gamuts 720 and 730. For example, for an increase of contrast, all three curves of channels R, G, B respectively will correspond to an increase of equivalent gamma value with correction by a factor "a." Thus, the curve of each channel will correspond to a gamma correction to a higher gamma value. Visually, the curves in FIG. 8 on all 3 channels will lower their respective middle point (e.g., 812, 822, and 832) based on a factor "a." The upper portion of each curve starting with the middle point and proceeding upward along the curve may be become steeper for this increase of contrast example.

Figure 9:
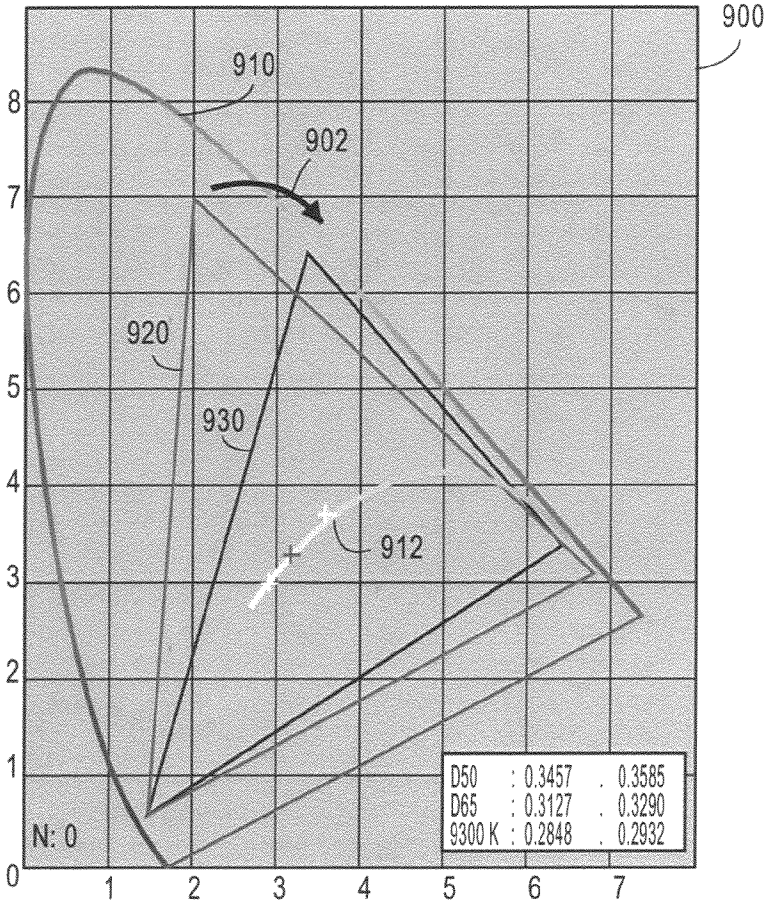
FIG. 9 shows a CIE chromaticity diagram with a gamut for a color managed display and a gamut for a non-color managed display in one embodiment of the present invention.

FIG. 9 shows a CIE 1931 chromaticity diagram with a gamut for a color managed display and a gamut for a non-color managed display in one embodiment of the present invention. The chromaticity diagram 900 includes x and y chromaticity coordinates derived from the tristimulus values X, Y, and Z, a color gamut 910 for all visible chromaticities, a black body locus or white point locus 912, a color gamut 920 for a color managed display in a system, and a color gamut 930 for a non-color managed display in the system. A translation 902 from gamut 920 to gamut 930 can be approximated as a hue difference between the gamuts. For example, the translation 902 can be measured based on a rotation from a first line (e.g., constant hue line such as a green hue line) associated with the gamut 920 to a second line (e.g., constant hue line such as green hue line) associated with the gamut 930. In one embodiment, the first line is a green hue line drawn from a white point of gamut 920 through an upper vertex of gamut 920 and the second line is a green hue line drawn from a white point of gamut 930 through an upper vertex of gamut 930. In this case, the hue difference is a yellow shift in moving from gamut 920 to gamut 930. The translation 902 may be proportional to a gamma correction on a single channel.

Figure 10:
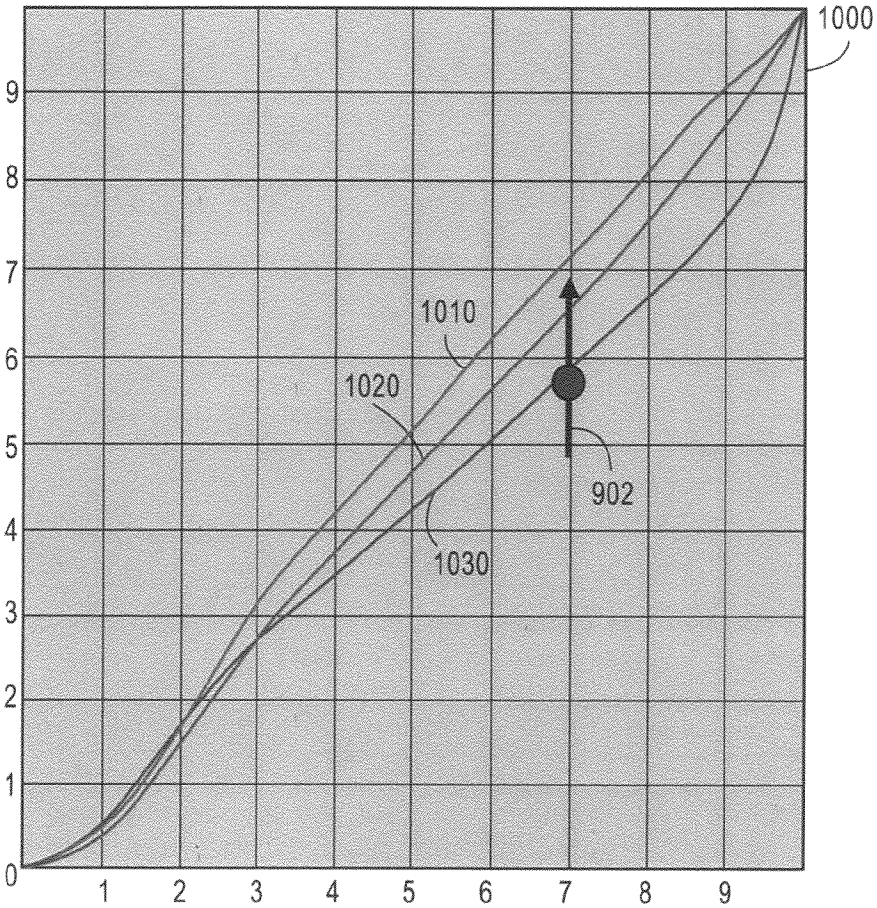
FIG. 10 illustrates a gamma diagram being modified for the non-color managed display in one embodiment of the present invention

FIG. 10 illustrates a gamma diagram being modified for the non-color managed display in one embodiment of the present invention. The translation 902 can be applied as a correction to the gamma curve 1030 in FIG. 10. Thus, the translation 902 and associated yellow shift may be used as a gamma correction (e.g., bluish compensation 902). In this manner, the LUT for the non-color managed display is modified to account for the hue difference between the gamuts 720 and 730. The primary colors of gamuts 920 and 930 are examined. A hue difference such as gamut 930 being more yellowish can be compensated by adjusting the blue channel so making gamut 930 less yellowish. This is accomplished by adjusting the blue gamma curve 1030 with compensation 902 as illustrated in FIG. 10.

Figure 11:
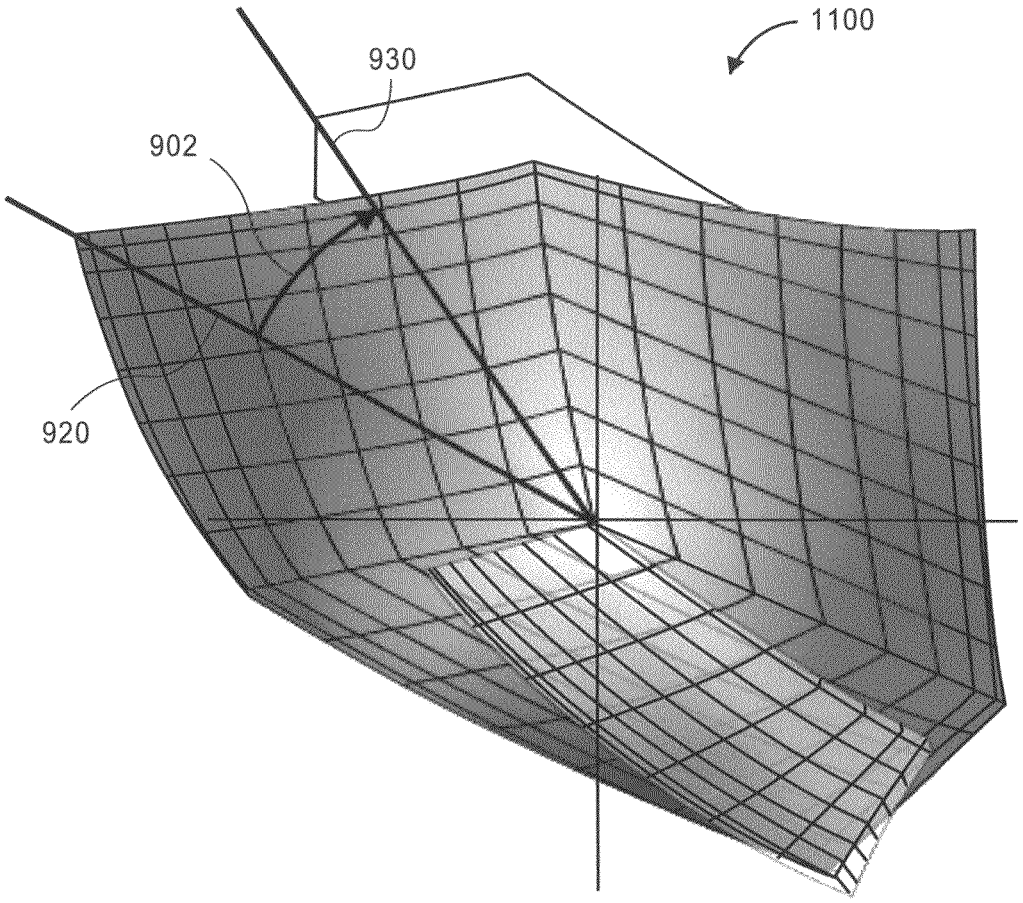
FIG. 11 shows a L*a*b color space diagram with a translation for a hue difference between a color managed display and a gamut for a non-color managed display in one embodiment of the present invention.

FIG. 11 shows an L*a*b color space diagram with a translation for a hue difference between a color managed display and a gamut for a non-color managed display in one embodiment of the present invention. The diagram 1100 includes a dimension L for lightness and color-opponent dimensions a and b derived from nonlinearly compressed CIE tristimulus values X, Y, and Z. The translation 902 represents a hue difference between a color gamut 920 for a color managed display in a system, and a color gamut 930 for a non-color managed display in the system. In this case, the hue difference is a yellow shift in moving from gamut 920 to gamut 930. The translation 902 may be proportional to a channel gamma as illustrated in FIG. 10.

Figure 12:
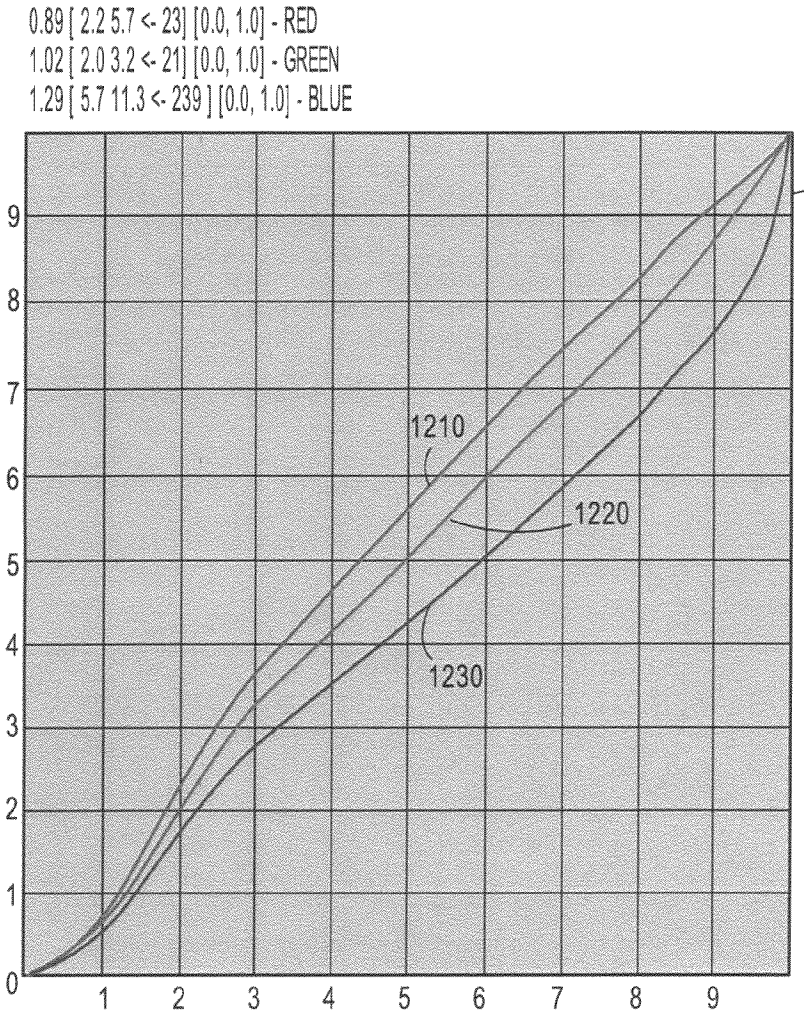
FIG. 12 illustrates a gamma diagram for a non-color managed display in one embodiment of the present invention.
Figure 13:
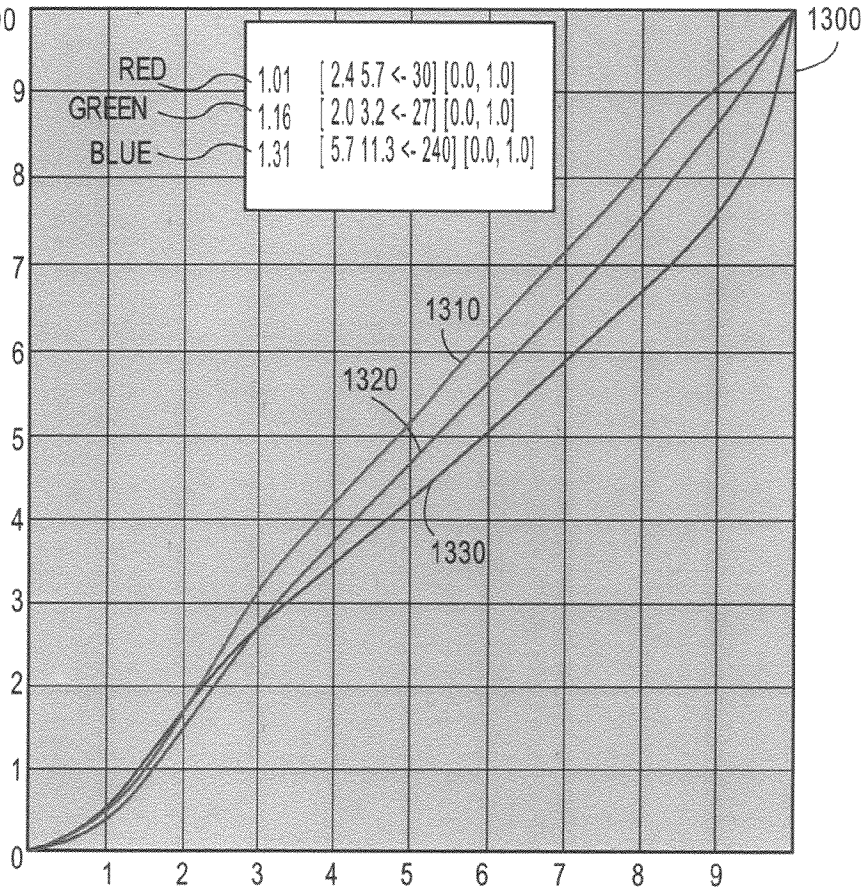
FIG. 13 illustrates a modified gamma diagram for a non-color managed display in one embodiment of the present invention.

FIGS. 12 and 13 illustrate a gamma correction by modifying gamma for the non-color managed display in one embodiment of the present invention. FIG. 12 illustrates a gamma diagram for a non-color managed display in one embodiment of the present invention. A global gamma can be applied to each gamma curve (e.g., red, green, blue) of the color managed display. Alternatively, a red component of the global gamma correction "$a_r$" can be applied to the red curve, a green component of the global gamma correction "$a_g$" can be applied to the green curve, and a blue component of the global gamma correction "$a_b$" can be applied to the blue curve. In this manner, the LUT for the non-color managed display is modified to account for the saturation difference between the gamuts 720 and 730. For example, a possible transformation has the following equation.

$$\text{gammaRGB}=\text{gammaRGB}*([w1]*M1+[w2]*M2)$$

M1 is a global gamma, M2 is a channel gamma, and w1 and w2 are weight matrices. For example, in the particular case in which only hue correction on the blue channel is required (i.e., for removing a yellowish tint by adding more opposite color blue), the equations for each primary color are as follows.

$$\text{gammaR}=\text{gammaR}*(1+\text{saturation correction})$$

$$\text{gammaG}=\text{gammaG}*(1+\text{saturation correction})$$

$$\text{gammaB}=\text{gammaB}*(1+\text{saturation correction}+\text{hue correction})$$

FIG. 13 illustrates a modified gamma diagram for a non-color managed display in one embodiment of the present invention. The gamma curves are modified according to the above equations. In this manner, the LUT (e.g., LUT for red, LUT for green, LUT for blue) for the non-color managed display is modified to account for the saturation difference and hue difference between the different gamuts (e.g., 720 and 730, 920 and 930).

In one embodiment, the red curve 1210 has a gamma value of 0.89, the green curve 1220 has a gamma value of 1.02, and the blue curve 1230 has a gamma value of 1.29. As discussed above, the gamma curves are modified according to the above equations to generate the gamma curves illustrated in FIG. 13. The red curve 1310 has a gamma value of 1.01, the green curve 1320 has a gamma value of 1.16, and the blue curve 1330 has a gamma value of 1.31. In this case, the contrast is increasing and the gamma curves visually are lowered or pushed down as illustrated in FIG. 13 based on the saturation correction. The hue correction for the blue gamma curve 1330 tends to push this curve upwards.

Figure 14:
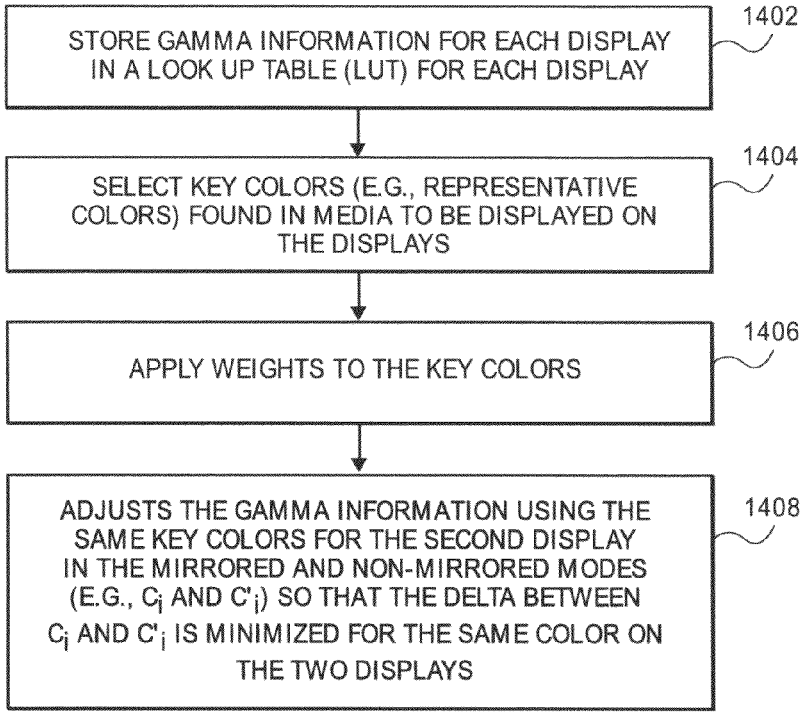
FIG. 14 illustrates a flow diagram in one embodiment of the present invention for a computer-implemented method of providing color correction for multiple displays in a data processing system.

FIG. 14 illustrates a flow diagram in one embodiment of the present invention for a computer-implemented method 1400 of providing color correction for multiple displays in a data processing system. The computer-implemented method 1400 is performed by processing logic that may comprise hardware (circuitry, dedicated logic, etc.), software (such as is run on a general purpose computer system or a dedicated machine or a system), or a combination of both. In one embodiment, the processing logic includes a multiple display system that is being implemented in a mirrored mode.

At block 1402, processing logic stores gamma information for each display in a look up table (LUT) for each display. At block 1404, processing logic selects key colors (e.g., representative colors) found in media to be displayed on the displays. For example, $C_{i(i=1)}$ may represent a skin tone color for a second display in a non-mirrored mode. $C_{i(i=2)}$ may represent a sky like color for the second display in the non-mirrored mode. $C_{i(i=3)}$ may represent a green leaf color and $C_{i(i=4)}$ may represent a standard gray card color for the second display in the non-mirrored mode. $C'_{i(i=1)}$ may represent the skin tone color for the second display in a mirrored mode. $C'_{i(i=2)}$ may represent the sky like color for the second display in the mirrored mode. $C'_{i(i=3)}$ may represent the green leaf color and $C'_{i(=4)}$ may represent the standard gray card color for the second display in the mirrored mode.

At block 1406, the processing logic applies weights to the key colors. At block 1408, the processing logic adjusts the gamma information using the same key colors for the second display in the mirrored and non-mirrored modes (e.g., $C_i$ and $C'_i$) so that the delta between $C_i$ and $C'_i$ is minimized for the same color on the two displays.

Figure 15:
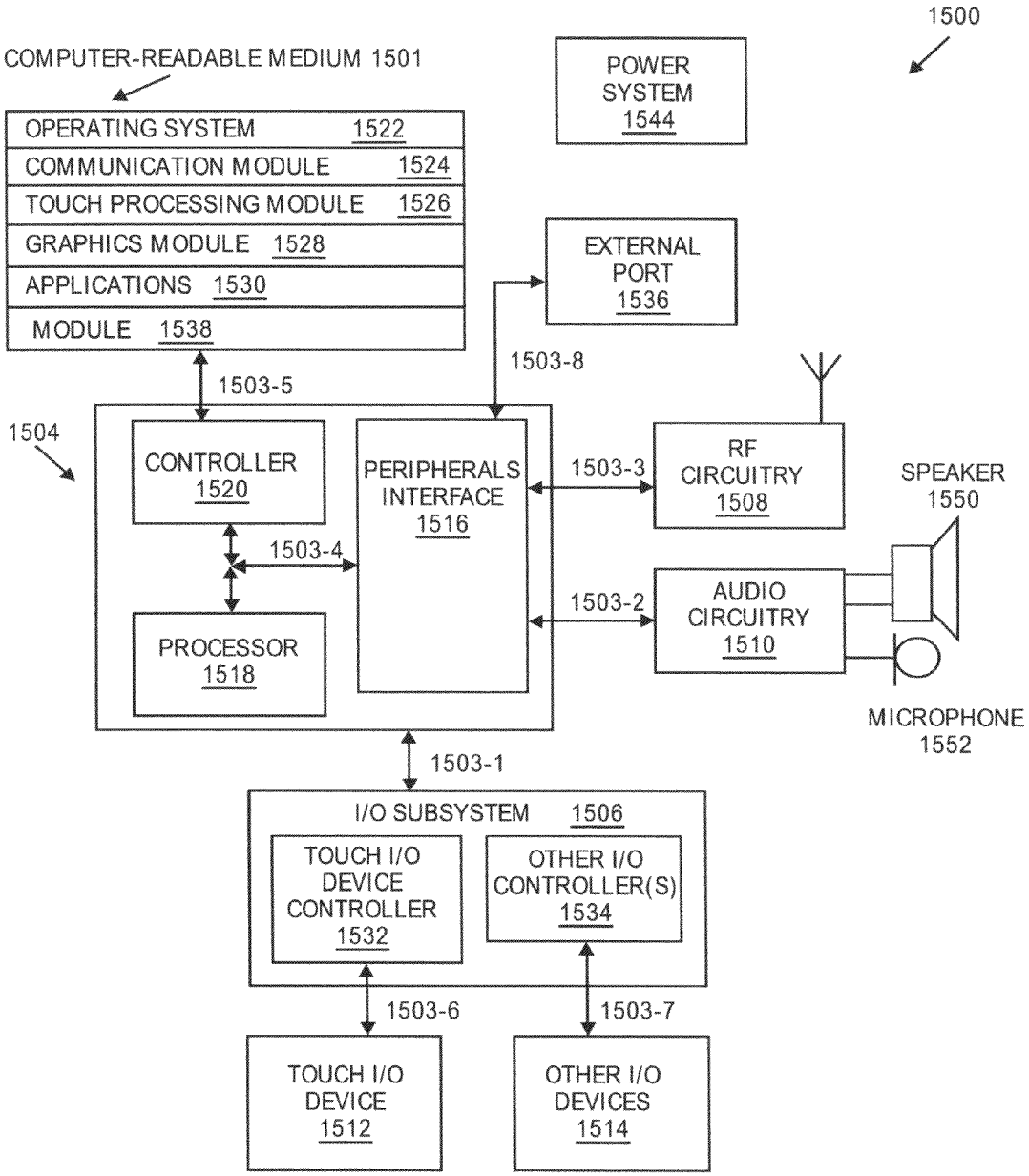
FIG. 15 is a block diagram of one embodiment of the present invention of a system that generally includes one or more computer-readable mediums, processing system, Input/Output (I/O) subsystem, radio frequency (RF) circuitry and audio circuitry.

Attention is now directed towards embodiments of a system architecture that may be embodied within any portable or non-portable device including but not limited to a communication device (e.g. mobile phone, smart phone), a multimedia device (e.g., MP3 player, TV, radio), a portable or handheld computer (e.g., tablet, netbook, laptop), a desktop computer, an All-In-One desktop, a peripheral device, or any other system or device adaptable to the inclusion of system architecture 1500, including combinations of two or more of these types of devices. FIG. 15 is a block diagram of one embodiment of the present invention of system 1500 that generally includes one or more computer-readable mediums 1501, processing system 1504, Input/Output (I/O) subsystem 1506, radio frequency (RF) circuitry 1508 and audio circuitry 1510. These components may be coupled by one or more communication buses or signal lines 1503.

It should be apparent that the architecture shown in FIG. 15 is only one example architecture of system 1500, and that system 1500 could have more or fewer components than shown, or a different configuration of components. The various components shown in FIG. 15 can be implemented in hardware, software, firmware or any combination thereof, including one or more signal processing and/or application specific integrated circuits.

RF circuitry 1508 is used to send and receive information over a wireless link or network to one or more other devices and includes well-known circuitry for performing this function. RF circuitry 1508 and audio circuitry 1510 are coupled to processing system 1504 via peripherals interface 1516. Interface 1516 includes various known components for establishing and maintaining communication between peripherals and processing system 1504. Audio circuitry 1510 is coupled to audio speaker 1550 and microphone 1552 and includes known circuitry for processing voice signals received from interface 1516 to enable a user to communicate in real-time with other users. In some embodiments, audio circuitry 1510 includes a headphone jack (not shown).

Peripherals interface 1516 couples the input and output peripherals of the system to processor 1518 and computer-readable medium 1501. One or more processing units 1518 communicate with one or more computer-readable mediums 1501 via controller 1520. Computer-readable medium 1501 can be any device or medium (e.g., storage device, storage medium) that can store code and/or data for use by one or more processing units 1518. Medium 1501 can include a memory hierarchy, including but not limited to cache, main memory and secondary memory. The memory hierarchy can be implemented using any combination of RAM (e.g., SRAM, DRAM, DDRAM), ROM, FLASH, magnetic and/or optical storage devices, such as disk drives, magnetic tape, CDs (compact disks) and DVDs (digital video discs). Medium 1501 may also include a transmission medium for carrying information-bearing signals indicative of computer instructions or data (with or without a carrier wave upon which the signals are modulated). For example, the transmission medium may include a communications network, including but not limited to the Internet (also referred to as the World Wide Web), intranet(s), Local Area Networks (LANs), Wide Local Area Networks (WLANs), Storage Area Networks (SANs), Metropolitan Area Networks (MAN) and the like.

One or more processing units 1518 run various software components stored in medium 1501 to perform various functions for system 1500. In some embodiments, the software components include operating system 1522, communication module (or set of instructions) 1524, touch processing module (or set of instructions) 1526, graphics module (or set of instructions) 1528, one or more applications (or set of instructions) 1530, and color management module [or set of instructions] 1538. The color management module corresponds to a set of instructions for performing one or more functions described above and the methods described in this application (e.g., the computer-implemented methods and other information processing methods described herein). These modules (i.e., sets of instructions) need not be implemented as separate software programs, procedures or modules, and thus various subsets of these modules may be combined or otherwise rearranged in various embodiments.

In some embodiments, medium 1501 may store a subset of the modules and data structures identified above. Furthermore, medium 1501 may store additional modules and data structures not described above.

Operating system 1522 includes various procedures, sets of instructions, software components and/or drivers for controlling and managing general system tasks (e.g., memory management, storage device control, power management, etc.) and facilitates communication between various hardware and software components.

Communication module 1524 facilitates communication with other devices over one or more external ports 1536 or via RF circuitry 1508 and includes various software components for handling data received from RF circuitry 1508 and/or external port 1536.

Graphics module 1528 includes various known software components for rendering, animating and displaying graphical objects on a display surface. In embodiments in which touch I/O device 1512 is a touch sensitive display (e.g., touch screen), graphics module 1528 includes components for rendering, displaying, and animating objects on the touch sensitive display.

One or more applications 1530 can include any applications installed on system 1500, including without limitation, a color management application, a browser, address book, contact list, email, instant messaging, word processing, keyboard emulation, widgets, JAVA-enabled applications, encryption, digital rights management, voice recognition, voice replication, location determination capability (such as that provided by the global positioning system (GPS)), a music player, etc.

Touch processing module 1526 includes various software components for performing various tasks associated with touch I/O device 1512 including but not limited to receiving and processing touch input received from I/O device 1512 via touch I/O device controller 1532.

System 1500 may further include color management module 1538 for performing the method/functions as described herein in connection with FIGS. 2-14. In one embodiment, the color management module 1538 may at least function to color manage input media having a media profile based on a color gamut of one of the displays (e.g., 316, 326) and to store the color managed media in a frame buffer (e.g., 311). The one or more processing units are configured to execute instructions to mirror the stored media in a mirrored mode onto both displays (e.g., 316, 326). In one embodiment, displays have different color gamuts. The one or more processing units are configured to execute instructions (e.g., instructions of color management module) to process the media for the second display (e.g., 326) through a gamma information for the second display. The gamma information is for a non-mirrored mode for the second display. The gamma information may be stored in a LUT for the second display.

The one or more processing units may be configured to execute instructions to determine a gamut ratio of the gamut size of the first display to the gamut size of the second display, to determine a saturation correction based on the gamut ratio, and to determine a gamma correction to modify the gamma information for the LUT (e.g., 324) of the second display based on the saturation correction.

The one or more processing units may be configured to execute instructions to compare hue data associated with the color gamut of the first display (e.g., 316) to hue data associated with the color gamut of the second display, to determine a hue correction based on the comparison of the hue data, and to determining a gamma correction to modify the gamma information for the LUT of the second display based on the hue correction.

Module 1538 may also interact with color management application 1530 to provide the methods and functionality described herein. Module 1538 may be embodied as hardware, software, firmware, or any combination thereof. Although module 1538 is shown to reside within medium 1501, all or portions of module 1538 may be embodied within other components within system 1500 or may be wholly embodied as a separate component within system 1500.

I/O subsystem 1506 is coupled to touch I/O device 1512 and one or more other I/O devices 1514 for controlling or performing various functions. Touch I/O device 1512 communicates with processing system 1504 via touch I/O device controller 2032, which includes various components for processing user touch input (e.g., scanning hardware). One or more other input controllers 2034 receives/sends electrical signals from/to other I/O devices 1514. Other I/O devices 1514 may include physical buttons, dials, slider switches, sticks, keyboards, touch pads, additional display screens, or any combination thereof.

If embodied as a touch screen, touch I/O device 1512 displays visual output to the user in a GUI. The visual output may include text, graphics, video, and any combination thereof. Some or all of the visual output may correspond to user-interface objects. Touch I/O device 1512 forms a touch-sensitive surface that accepts touch input from the user. Touch I/O device 1512 and touch screen controller 1532 (along with any associated modules and/or sets of instructions in medium 1501) detects and tracks touches or near touches (and any movement or release of the touch) on touch I/O device 1512 and converts the detected touch input into interaction with graphical objects, such as one or more user-interface objects. In the case in which device 1512 is embodied as a touch screen, the user can directly interact with graphical objects that are displayed on the touch screen. Alternatively, in the case in which device 1512 is embodied as a touch device other than a touch screen (e.g., a touch pad), the user may indirectly interact with graphical objects that are displayed on a separate display screen embodied as I/O device 1514.

Embodiments in which touch I/O device 1512 is a touch screen, the touch screen may use LCD (liquid crystal display) technology, LPD (light emitting polymer display) technology, OLED (organic LED), or OEL (organic electro luminescence), although other display technologies may be used in other embodiments.

Feedback may be provided by touch I/O device 1512 based on the user's touch input as well as a state or states of what is being displayed and/or of the computing system. Feedback may be transmitted optically (e.g., light signal or displayed image), mechanically (e.g., haptic feedback, touch feedback, force feedback, or the like), electrically (e.g., electrical stimulation), olfactory, acoustically (e.g., beep or the like), or the like or any combination thereof and in a variable or non-variable manner.

System 1500 also includes power system 1544 for powering the various hardware components and may include a power management system, one or more power sources, a recharging system, a power failure detection circuit, a power converter or inverter, a power status indicator and any other components typically associated with the generation, management and distribution of power in portable devices.

In some embodiments, peripherals interface 1516, one or more processing units 1518, and memory controller 1520 may be implemented on a single chip, such as processing system 1504. In some other embodiments, they may be implemented on separate chips.

In certain embodiments of the present disclosure, the system 3003 or system 1500 or combinations of systems 3003 or 1500 can be used to implement at least some of the methods discussed in the present disclosure.

Some portions of the detailed descriptions are presented in terms of algorithms which include operations on data stored within a computer memory. An algorithm is generally a self-consistent sequence of operations leading to a desired result. The operations typically require or involve physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, can refer to the action and processes of a data processing system, or similar electronic device, that manipulates and transforms data represented as physical (electronic) quantities within the system's registers and memories into other data similarly represented as physical quantities within the system's memories or registers or other such information storage, transmission or display devices.

The present disclosure can relate to an apparatus for performing one or more of the operations described herein. This apparatus may be specially constructed for the required purposes, or it may comprise a general purpose computer selectively activated or reconfigured by a computer program stored in the computer. Such a computer program may be stored in a machine (e.g. computer) readable storage medium, such as, but is not limited to, any type of disk including floppy disks, optical disks, CD-ROMs, and magnetic-optical disks, read-only memories (ROMs), random access memories (RAMs), erasable programmable ROMs (EPROMs), electrically erasable programmable ROMs (EEPROMs), flash memory, magnetic or optical cards, or any type of media suitable for storing electronic instructions, and each coupled to a bus.

A machine-readable medium includes any mechanism for storing or transmitting information in a form readable by a machine (e.g., a computer). For example, machines store and communicate (internally and with other devices over a network) code and data using machine-readable media, such as machine storage media (e.g., magnetic disks; optical disks; random access memory; read only memory; flash memory devices; phase-change memory).

In the foregoing specification, the disclosure has been described with reference to specific exemplary embodiments thereof. It will be evident that various modifications may be made thereto without departing from the broader spirit and scope of the disclosure as set forth in the following claims. The specification and drawings are, accordingly, to be regarded in an illustrative sense rather than a restrictive sense.

What is claimed is:

1. A computer-implemented method, comprising:

color managing media based on a first color gamut of a first display;

mirroring the media in a mirrored mode onto the first display and a second display, wherein the first and second displays have different color gamuts; and processing the media for the second display through modifying a gamma information for the second display without using a color profile for the second display wherein the gamma information is designed for a non-mirrored mode for the second display with independent color management per each display.

2. The method of claim 1, further comprising:

storing the gamma information for the second display in a look up table (LUT) for the second display; and storing the color managed media in a frame buffer and wherein the gamma information provides a color profile management for the second display that is based on the second display and is independent of the first display.

3. The method of claim 1, further comprising:

computing a gamut size of the first display;

computing a gamut size of the second display; and determining a gamut ratio of the gamut size of the first display to the gamut size of the second display and wherein the first display and the second display are driven by the same frame buffer.

4. The method of claim 3 further comprising:

determining a saturation correction based on the gamut ratio.

5. The method of claim 1, further comprising:

determining a gamma correction to modify the gamma information of the second display based on a saturation correction.

6. The method of claim 1 further comprising:

comparing hue data associated with the color gamut of the first display to hue data associated with the color gamut of the second display; and determining a hue correction based on the comparison of the hue data.

7. The method of claim 6, further comprising:

determining a gamma correction to modify the gamma information for the second display based on the hue correction.

8. A non-transitory computer-readable medium containing executable computer program instructions which when executed by a computing system cause said system to perform a method, the method comprising:

color managing media based on a first color gamut of a first display;

mirroring the media in a mirrored mode onto the first display and a second display, wherein the first and second displays have different color gamuts; and processing the media for the second display through modifying a gamma information for the second display without using a color profile for the second display wherein the gamma information is for a non-mirrored mode for the second display and provides a color management for the second display that is based on the second display and is independent of the first display and wherein the same frame buffer drives both the first display and the second display.

9. The non-transitory computer-readable medium of claim 8, the method further comprising:

storing the gamma information for the second display in a look up table (LUT) for the second display; and storing the color managed media in a frame buffer.

10. The non-transitory computer-readable medium of claim 8, the method further comprising:

computing a gamut size of the first display;

computing a gamut size of the second display; and determining a gamut ratio of the gamut size of the first display to the gamut size of the second display.

11. The non-transitory computer-readable medium of claim 10, the method further comprising:

determining a saturation correction based on the gamut ratio.

12. The non-transitory computer-readable medium of claim 11, the method further comprising:

determining a gamma correction to modify the gamma information of the second display based on the saturation correction.

13. The non-transitory computer-readable medium of claim 8, the method further comprising:

comparing hue data associated with the color gamut of the first display to hue data associated with the color gamut of the second display; and determining a hue correction based on the comparison of the hue data.

14. The non-transitory computer-readable medium of claim 13, the method further comprising:

determining a gamma correction to modify the gamma information for the second display based on the hue correction.

15. A data processing system, comprising:

a first display device and a second display device to display media; and one or more processing units coupled to the first display device and the second display device, the one or more processing units are configured to execute instructions to color manage input media having a media profile based on a color gamut of the first display device, to store the media in a frame buffer, to mirror the stored media in a mirrored mode onto the first and second display devices, and to process the media for the second display device through modifying a gamma information for the second display device without using a color profile for the second display wherein the gamma information is for a non-mirrored mode for the second display device.

16. The data processing system of claim 15, wherein a color gamut of the second display device is different than the color gamut of the first display device.

17. The data processing system of claim 16, wherein the first display device and the second display device are driven by the same frame buffer.

18. The data processing system of claim 15, wherein the gamma information may be stored in a LUT for the second display device and wherein the gamma information provides a color profile management for the second display device that is based on the second display device and is independent of the first display device.

19. The data processing system of claim 15, wherein the one or more processing units are configured to execute instructions to determine a gamut ratio of a gamut size of the first display device to a gamut size of the second display device.

20. The data processing system of claim 19, wherein the one or more processing units are configured to execute instructions to determine a saturation correction based on the gamut ratio.

21. The data processing system of claim 20, wherein the one or more processing units are configured to execute instructions to compare hue data associated with the color gamut of the first display device to hue data associated with the color gamut of the second display device.

22. The data processing system of claim 21, wherein the one or more processing units are configured to execute instructions to determine a hue correction based on the comparison of the hue data.

23. The data processing system of claim 22, wherein the one or more processing units are configured to execute instructions to determining a gamma correction to modify the gamma information of the second display device based on the saturation correction and the hue correction.

* * * * *